US005913334A

United States Patent [19]

Hyun

[11] Patent Number: 5,913,334

[45] Date of Patent: Jun. 22, 1999

[54] APPARATUS FOR INDUCING PRESSURE DROP ON FLUE GAS EXHAUSTION

[76] Inventor: Kwangsoo Hyun, SUT 8-30 Nhoyoo-1-Dong/Kwangjin-Gu, Seoul, 143-301, Rep. of Korea

[21] Appl. No.: 08/756,227

[22] Filed: Nov. 25, 1996

[51] Int. Cl.[6] ..... F15C 1/16

[52] U.S. Cl. ..... 137/810; 137/813

[58] Field of Search ..... 137/808, 809, 137/810, 811, 812, 813

[56] References Cited

U.S. PATENT DOCUMENTS

| | | | |
|---|---|---|---|
| 3,207,168 | 9/1965 | Warren | 137/810 |
| 3,256,899 | 6/1966 | Dexter et al. | 137/810 |
| 3,336,931 | 8/1967 | Fox et al. | 137/813 |
| 3,511,257 | 5/1970 | Chow | 137/813 |
| 3,513,865 | 5/1970 | Der Heyden | 137/813 |
| 4,969,481 | 11/1990 | Horii | 137/813 |
| 5,080,137 | 1/1992 | Adams | 137/810 |
| 5,188,868 | 2/1993 | Horrii et al. | 137/808 |

*Primary Examiner*—A. Michael Chambers

[57] ABSTRACT

An integral, semi-integral, or modular apparatus for inducing pressure drop between upstream and downstream of the apparatus for exhaustion of flue gas as through the exhaust piping of a cyclone separator, smoke stack of boilers, or other exhaust piping is presented. The invented 1st apparatus comprises 1st plenum confinement means having a 1st and 2nd CO(circular opening) on upper and lower side thereof respectively, a 1st circular OC(outer cylinder) inserted downward through the 1st CO and secured, and a 1st circular IC (inner cylinder) inserted upward through the 2nd CO and secured, whereby pressurized gas retained in the 1st plenum confinement means is injected to make a 1st annular jet through a 1st annular passage defined by outer surface of the 1st IC and inner surface of the 1st OC so that the flue gas flow inside of the 1st IC is easily sucked up toward downstream of the 1st apparatus due to the pressure drop caused by high kinetic energy of the vertical velocity component of the 1st annular jet.

12 Claims, 9 Drawing Sheets

FIG. 2
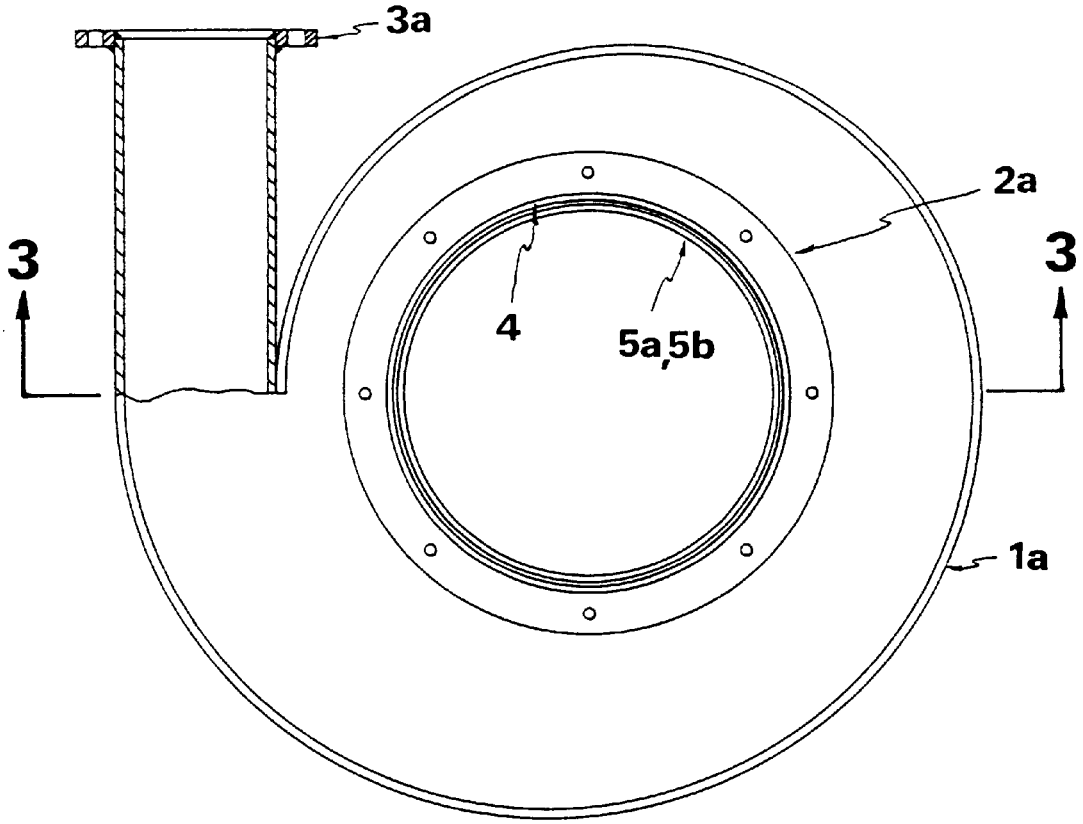
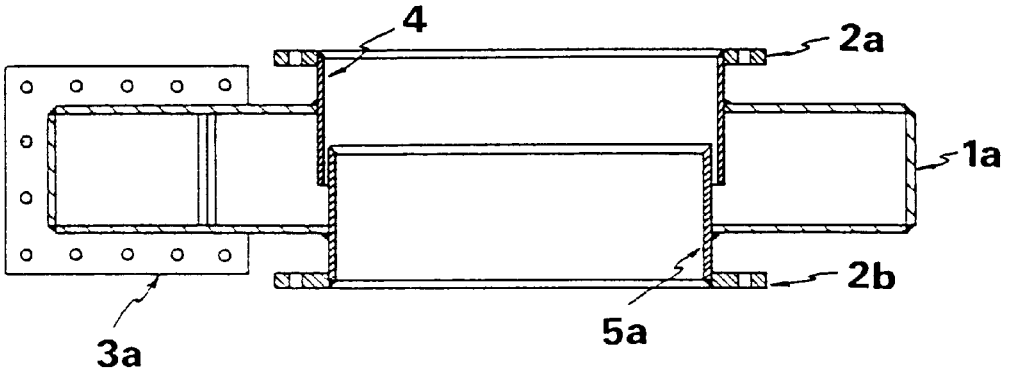
FIG. 3

FIG. 10
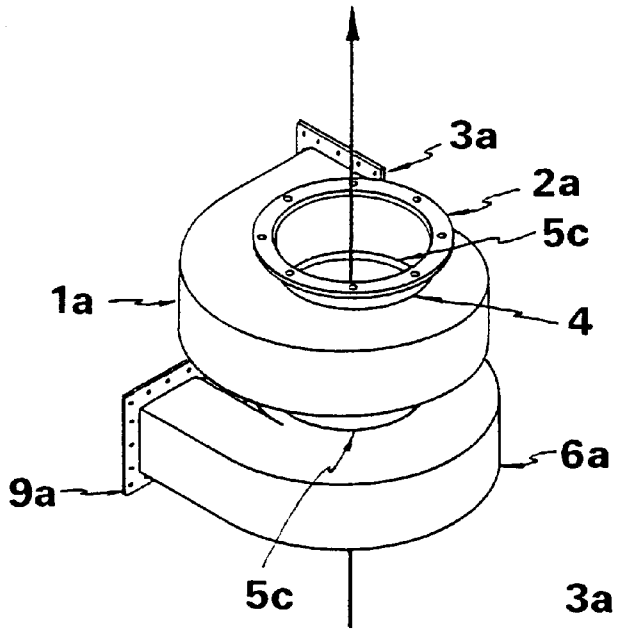
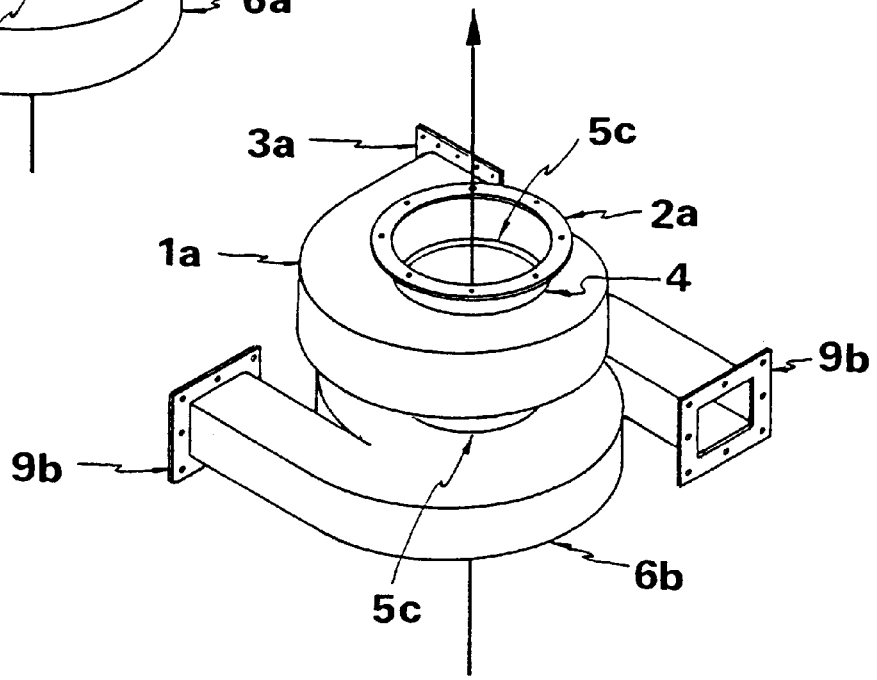
FIG. 11

APPARATUS FOR INDUCING PRESSURE DROP ON FLUE GAS EXHAUSTION

BACKGROUND

The present invention relates to an apparatus for including pressure drop on flue gas exhaustion for use on the smoke stack as of a cyclone separator of an incinerator furnace or of a boiler to replace troublesome induction fan for sucking exhaust gas into the ambient.

The conventional means for sucking exhaust gas into the ambient has been of placing an induction fan on the downstream of the smoke stack or other gas exhaust duct or piping. Since the conventional means for inducing lowered pressure compared with the pressure in the upstream of the smoke stack or other exhaust ducts is exposed to elevated temperatures of the exhaust gases being sucken into the ambient, means for protecting fan drive motor from being exposed to elevated temperature of the exhaust gas is needed on top of regular elimination of soots and ducts accumulated on the blades of the induction fan.

Due to the above mentioned negative design features of the current exhaust gas sucking-up means, a need for the advent of an apparatus without having any rotating devices therein and without need for regular maintenance thereof for developing pressure drop arises therefrom.

SUMMARY

The present invention is intended to overcome the above described disadvantages of the conventional induction fan for sucking exhaust gas up as into the ambient by placing an integral, semi-integral, or modular apparatus either in the middle or at the downstream end of the exhaust pipe or duct so that high pressure difference between upstream and downstream of the apparatus is developed so that the exhaust gas is easily sucken up and driven into the downstream of the apparatus.

The 1st version of the invention comprises a 1st stage outer cylinder( hereinafter referred to as "OC"); a 1st stage inner cylinder( hereinafter referred to as "IC"), outer diameter of the 1st stage IC being smaller in magnitude thereof than inner diameter of the 1st stage OC; and 1st stage plenum-confinement means having at least one pressurized first-gas intake port and a 1st and 2nd circular opening on upper and lower side of the 1st stage plenum-confinement means respectively. The 1st stage OC and IC is then secured to the 1st and 2nd circular opening respectively in coaxial alignment such that pressurized first gas in the 1st stage plenum-confinement means is driven through a first annular passage defined by outer surface of the 1st stage IC and inner surface of the 1st stage OC so that exhaustion of flue gas flowing upward inside of the 1st stage IC is boosted downstream due to annular jet of the pressurized first gas in the 1st stage plenum-confinement means through the first annular passage.

The apparatus in accordance with the 1st version of the invention may be carried out either as an integral apparatus in the middle of a piping wherein flue gas flows or as a semi-integral or modular unit for achieving the intended purposes of the apparatus by securing a 1st stage upstream mounting flange to upstream end of the 1st stage IC, a 1st stage downstream mounting flange to downstream end of the 1st stage OC, or the 1st stage downstream and upstream mounting flange to downstream end of the 1st stage OC and upstream end of the 1st stage IC respectively.

The 2nd version of the invention is the 1st version of the invention further comprising a 2nd stage OC, inner diameter of which is approximately the same in magnitude thereof as the inner diameter of the 1st stage IC; a 2nd stage downstream mounting flange secured to upper end of the 2nd stage OC, the 2nd stage downstream mounting flange being compatible with the 1st stage upstream mounting flange for hermetic seal; a 2nd stage IC, outer diameter of which is smaller in magnitude thereof than the inner diameter of the 2nd stage OC; and 2nd stage plenum-confinement means having at least one pressurized second-gas intake port and a 3rd and 4th circular opening on upper and lower side of the 2nd stage plenum-confinement means respectively. The 2nd stage OC and IC is then secured to the 3rd and 4th circular opening respectively in coaxial alignment such that pressurized second gas in the 2nd stage plenum-confinement means is driven through a second annular passage defined by outer surface of the 2nd stage IC and inner surface of the 2nd stage OC so that exhaustion of the flue gas flowing through the 2nd stage IC is boosted downstream due to annular jet of the pressurized second gas in the 2nd stage plenum-confinement means through the second annular passage.

The apparatus in accordance with the 2nd version of the invention may also be carried out either as in the middle of a piping wherein flue gas flows or as a modular unit for achieving the intended purposes of the apparatus in two separate modular stages by securing a 2nd stage upstream mounting flange to upstream end of the 2nd stage IC.

The 3rd version of the invention comprises an OC; an intermediate cylinder (hereinafter referred to as "IMC"), outer diameter of the IMC being smaller in magnitude thereof than inner diameter of the OC; an IC, outer diameter of the IC being smaller in magnitude thereof than inner diameter of the IMC; 1st stage plenum-confinement means having at least one pressurized first-gas intake port and a 1st and 2nd circular opening on upper and lower side of the 1st stage plenum-confinement means respectively; and 2nd stage plenum-confinement means having at least one pressurized second-gas intake port and a 3rd and 4th circular opening on upper and lower side of the 2nd stage plenum-confinement means respectively. The OC, IMC, and IC is then secured to the 1st, 2nd and 3rd, and 4th circular opening respectively in all coaxial alignment such that pressurized first gas in the 1st stage plenum-confinement means is driven upward through a first annular passage defined by outer surface of the IMC and inner surface of the OC, and that pressurized second gas in the 2nd stage plenum-confinement means is also driven upward through a second annular passage defined by outer surface of the IC and inner surface of the IMC so that exhaustion of flue gas flowing upward through the IC is boosted downstream due to first annular jet of the pressurized first gas in the 1st stage plenum-confinement means through the first annular passage and to second annular jet of the pressurized second gas in the 2nd stage plenum-confinement means through the second annular passage.

The apparatus in accordance with the 3rd version of the invention may be carried out either as an integral apparatus in the middle of a piping wherein flue gas flows or as a semi-integral or modular unit for achieving the intended purposes of the apparatus by securing an upstream mounting flange to upstream end of the IC, a downstream mounting flange to downstream end of the OC, or the downstream and upstream mounting flange to downstream end of the OC and upstream end of the IC respectively.

BRIEF DESCRIPTION OF THE DRAWINGS

These and other objects, aspects, features and many of the attendant advantages of this invention will be appreciated more readily as the same become better understood from a reading of the following detailed description when considered in connection with the accompanying drawings, wherein like parts in each of the several figures are identified by the same reference number selectively with a lower-case alphabetical character attached thereto, and wherein:

FIG. 2 is a partially cut-away planform view of the modular apparatus of FIG. 1;

FIG. 3 is a longitudinal sectional view taken along "3—3", of FIG. 2;

FIG. 4B is a perspective view of the modular 1st stage pressure-drop induction apparatus having one air intake flange with two mutually different embodiments of 1st stage IC respectively while FIG. 4C and FIG. 4D is a view of the modular 1st stage apparatus having two air intake flanges with two mutually different embodiments of the 1st stage IC respectively in accordance with the present invention;

FIG. 5B shows a perspective view of modular 2nd stage pressure-drop induction apparatus having one steam intake flange with two different embodiments of 2nd stage IC respectively while FIG. 5C and FIG. 5D is a perspective view of the 2nd stage apparatus having two steam intake flanges with two different embodiments of the 2nd stage IC respectively according to the present invention;

FIG. 10 is a perspective view of the modular double-stage pressure-drop induction apparatus having an air plenum with one air intake port, and a steam plenum with one steam intake port;

FIG. 11 is a perspective view of the modular double-stage pressure-drop induction apparatus having an air plenum with one air intake port, and a steam plenum with two steam intake ports.

DETAILED DESCRIPTION

Figure 1:
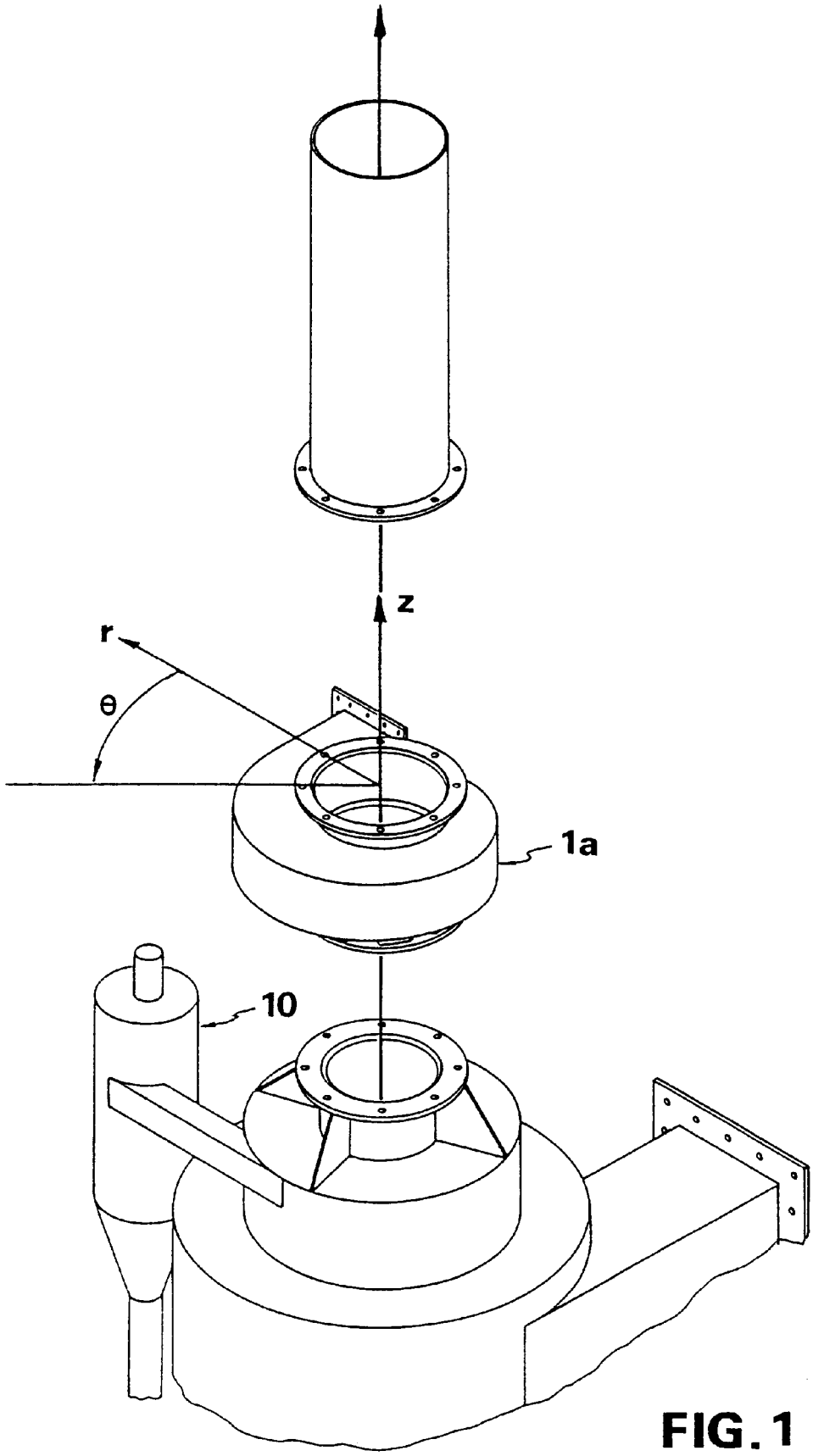
FIG. 1 is a bird's eye view of a 1st stage pressure-drop induction apparatus according to the present invention which is mounted downstream of a cyclone separator of an incinerator furnace.

FIG. 1 is a bird's eye view of a 1st stage pressure-drop induction apparatus according to the present invention which is mounted downstream of a cyclone separator of an incinerator furnace. The cyclone separator partially shown here is nested in a coolant water jacket with a steam-water separator 10 connected thereto. The direction of exhaustion of flue gas coming out of the cyclone separator is indicated as "z" while radial and circumferential direction is marked as "r" and respectively. The modular 1st stage induction apparatus is mounted on top of the central exhaust piping of the cyclone separator as with bolts and nuts, and a smoke stack is to be stacked thereon. Magnitude of radial height of cross section of 1st stage plenum la with pressurized air therein diminishes in spiral fashion with respect to circumferential 'theta' direction for uniform vertical, z, air-jet velocity profile in that direction.

FIG. 2 and FIG. 3 is a partially cut-away planform view of the modular apparatus of FIG. 1 and a longitudinal sectional view taken along "3—3" of FIG. 2 respectively. Pressurized air is supplied either from a main forward drive fan or from an auxiliary one into the 1st stage plenum la through one air intake port with an air intake flange 3*a* welded thereto, and constant vertical air jet velocity is developed through a first annular passage defined by outer surface of a 1st stage inner cylinder( hereinafter referred to as "IC") 5*a* with a 1st stage upstream mounting flange 2*b* welded to lower end thereof and by inner surface of a 1st stage outer cylinder( hereinafter referred to as "OC") 4 with a 1st stage downstream mounting flange 2*a* welded to upper end thereof. Virtual vertical center line of each of the 1st stage IC 5*a* and the 1st stage OC 4 is in coaxial alignment so that the first annular passage is invariant with respect to circumferential direction of the apparatus.

Figure 4:
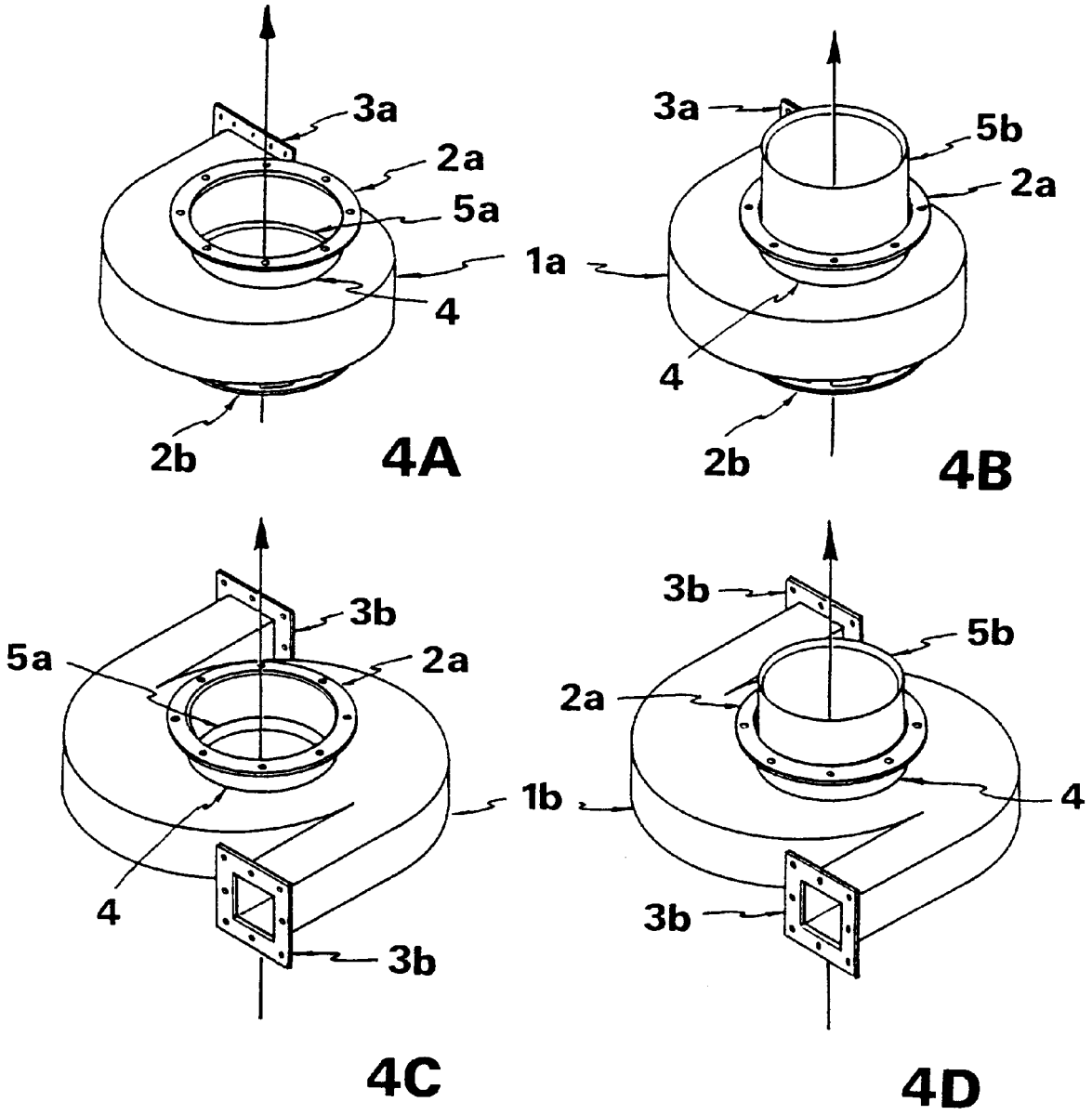
FIG. 4: 4A

FIG. 4A and FIG. 4B is a perspective view of the modular 1st stage pressure-drop induction apparatus having one air intake flange 3*a* with two mutually different embodiments of 1st stage IC 5*a*,5*b* respectively while FIG. 4C and FIG. 4D is a view of the modular 1st stage apparatus having two air intake flanges 3*b* with two mutually different embodiments of the 1st stage IC 5*a*,5*b* respectively in accordance with the present invention. The 1st stage OC 4 is inserted downward with lower end thereof ahead into a 1st circular opening on upper side of the 1st stage plenum 1*a*,1*b* and welded while the 1st stage IC 5*a*,5*b* ( shown in FIG. 3 ) is inserted upward with upper end thereof ahead into a 2nd circular opening on lower side of the 1st stage plenum 1*a*,1*b* and welded in such a way that the 1st stage OC 4 and the 1st stage IC 5*a*,5*b* is disposed concentrically so that pressurized air in the 1st plenum 1*a* escapes through a first annular passage defined by outer surface of the 1st stage IC 5*a*,5*b* and inner surface of the 1st stage OC 4. The 1st stage downstream mounting flange 2*a* and 1st stage upstream mounting flange 2*b* is welded on the upper end of the 1st stage OC 4 and on the lower end of the 1st stage IC 5*a* respectively so that the suction module can be mounted as on a central exhaust piping of a cyclone separator and that a smoke stack can be mounted thereon in flange coupling. The difference between the first embodiment of the 1st stage IC 5*a* in FIGS. 4A and 4C and the second embodiment of the 1st stage IC 5*b* in FIGS. 4B and 4D is that elevation of annular muzzle for air jet is located below upper flange coupling for the first embodiment while located above the upper flange coupling for the second embodiment for maintaining relatively uninterrupted vertical velocity component of annular jet. It is to be noted that two mutually different pressurized gases, inclusive of air, may be supplied through each of the two intake ducts of the 1st stage plenum 1*b* respectively.

Figure 5:
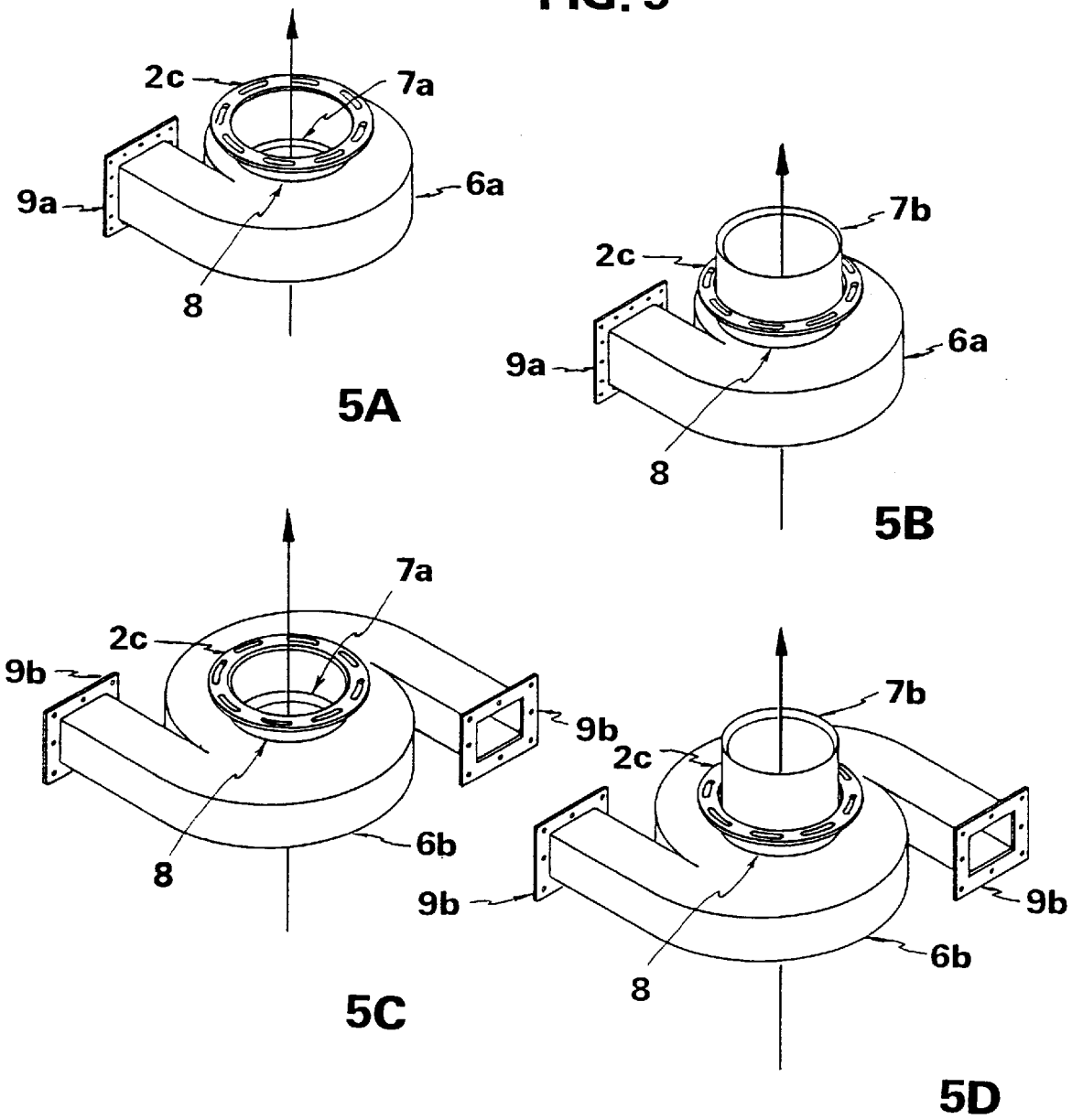
FIG. 5: 5A

FIG. 5A and FIG. 5B shows a perspective view of modular 2nd stage pressure-drop induction apparatus having one steam intake flange 9*a* with two different embodiments of 2nd stage IC 7*a*,7*b* respectively while FIG. 5C and FIG. 5D is a perspective view of the 2nd stage apparatus having two steam intake flanges 9*b* with two different embodiments of the 2nd stage IC 7*a*,7*b* respectively according to the present invention. The 2nd stage OC 8 is inserted downward with lower end thereof ahead into a 3rd circular opening on upper side of 2nd stage plenum 6*a*,6*b* and welded while the 2nd stage IC 7*a*,7*b* is inserted upward with upper end thereof ahead into a 4th circular opening on lower side of the 2nd stage plenum 6*a*,6*b* and welded in such a way that the 2nd stage OC 8 and the 2nd stage IC 7*a*,7*b* is disposed concentrically. A 2nd stage downstream mounting flange 2*c* and a 2nd stage upstream mounting flange 2*d* is welded on the upper end of the 2nd stage OC 8 and on the lower end of the 2nd stage IC 7*a*,7*b* respectively so that the 1st stage modular pressure-drop induction apparatus can be mounted on the 2nd stage apparatus mounted as on a central cylindrical piping of a cyclone separator and then a smoke stack can be mounted thereon in flange coupling. The difference between the first embodiment of the 2nd stage IC 7*a* in FIGS. 5A and 5C and the second embodiment of the 2nd stage IC 7*b* in FIGS. 5B and 5D is that elevation of annular muzzle for steam jet is located below upper flange coupling for the first embodiment while located above the upper flange coupling for the second embodiment for maintaining relatively uninterrupted vertical velocity component of annular jet. It is, here again, to be noted that two mutually different gases, inclusive of steam, may be supplied through each of the two intake ducts of the 1st stage plenum 6*b* respectively.

Figure 6:
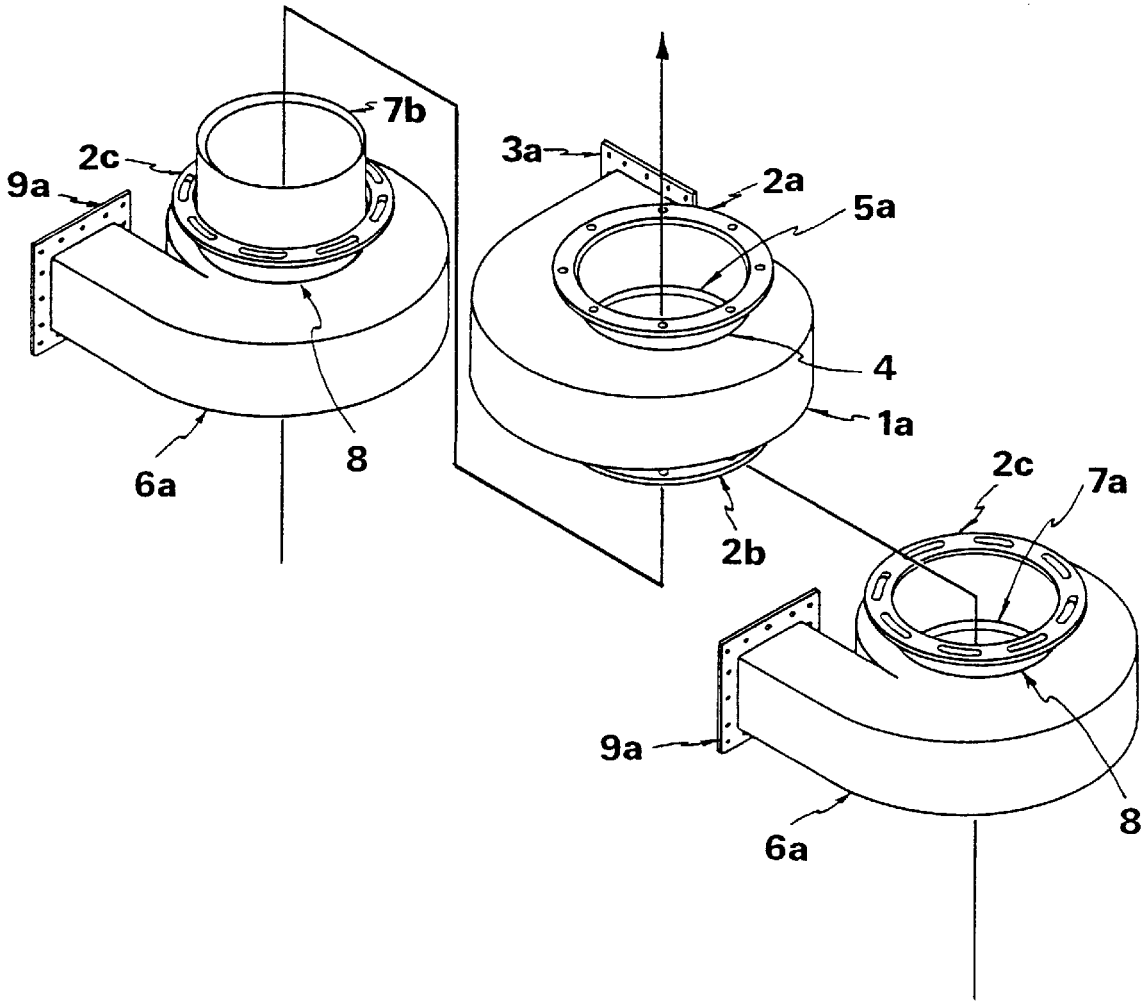
FIG. 6 is a perspective view showing how the modular 1st stage apparatus having one air intake flange and each of the two modular 2nd stage apparati, one having a first embodiment of the 2nd stage IC and the other a second embodiment of the 2nd stage IC, are assembled together.

FIG. 6 is a perspective view showing how the modular 1st stage apparatus having one air intake flange 3*a* and each of the two modular 2nd stage apparati, one having a first embodiment of the 2nd stage IC 7*a* and the other a second embodiment of the 2nd stage IC 7*b*, are assembled together. The central figure is the modular 1st stage apparatus disclosed in FIG. 4A and each of the modular 2nd stage apparati on the left hand side and on the right hand side is the one shown in FIG. 5B and FIG. 5A respectively. Bolt holes on the 2nd stage downstream mounting flange are made such that infinitesimal angular adjustment can be made in making flange coupling between the 1st and 2nd stage apparatus. The only difference between the 1st stage apparatus and the 2nd stage apparatus is that inner diameter of the 1st stage IC 5*a*,5*b* is the same as that of the 2nd stage OC 8 and that outer diameter of the 2nd IC 7*a*,7*b* is smaller in magnitude thereof than inner diameter of the 2nd stage OC 8. The pressurized gas in the 1st stage plenum 1*a*,1*b* can be either the same as or different from that in the 2nd stage plenum 6*a*,6*b*.

Figure 7:
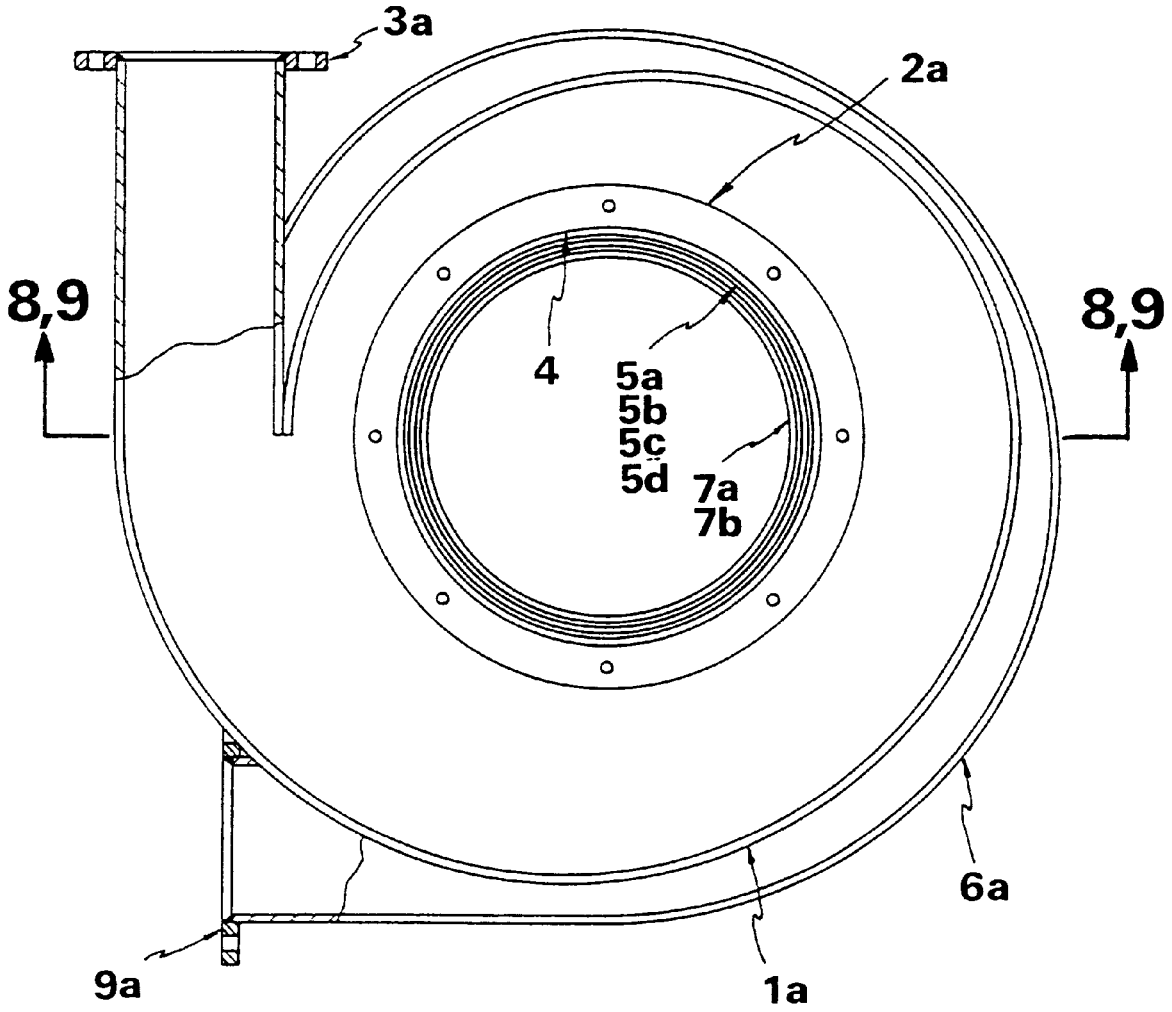
FIG. 7 is a partially cut-away planform view of either a combination of the modular 1st stage induction apparatus and the modular 2nd stage induction apparatus or a modular double-stage induction apparatus.

FIG. 7 is a partially cut-away planform view of either a combination of the modular 1st stage induction apparatus of FIG. 4A or 4B and the modular 2nd stage induction apparatus as disclosed in FIG. 5A or 5B or a modular double-stage induction apparatus that will be disclosed in FIG. 10. In case the double-stage induction apparatus is mounted on the central exhaust piping of the cyclone separator of an incinerator furnace having water jacket means therein, then working fluid in the 1st stage plenum 1*a*,1*b* and in the 2nd stage plenum 6*a*,6*b* may be air and steam respectively. Annular steam jet coming out of the 2nd stage plenum 6*a*,6*b* and inner surface of a smoke stack mounted on the 1st stage modular induction apparatus is separated by an annular air jet being exhausted out of the 1st stage plenum 1*a*,1*b* so that kinetic energy of steam that has absorbed waste heat of incineration which would otherwise be exhausted into the ambient is utilized and that corrosion on the inner surface of the smoke stack is retarded further downstream of the apparatus to a certain extent as well due to shield effect of the annular air jet in touch with the inner surface of the smoke stack. Due to the so-called "no-slip" condition, three velocity components of the flue gas, Vr, $V_\theta$, and Vz, are zero on the inner surface of the central exhaust piping of the cyclone separator so that when an annular air jet having a very high z velocity component is made just inside of the smoke stack then a big static pressure drop for the flue gas between upstream and downstream of the induction apparatus is developed, thus creating a suction effect.

Figure 8:
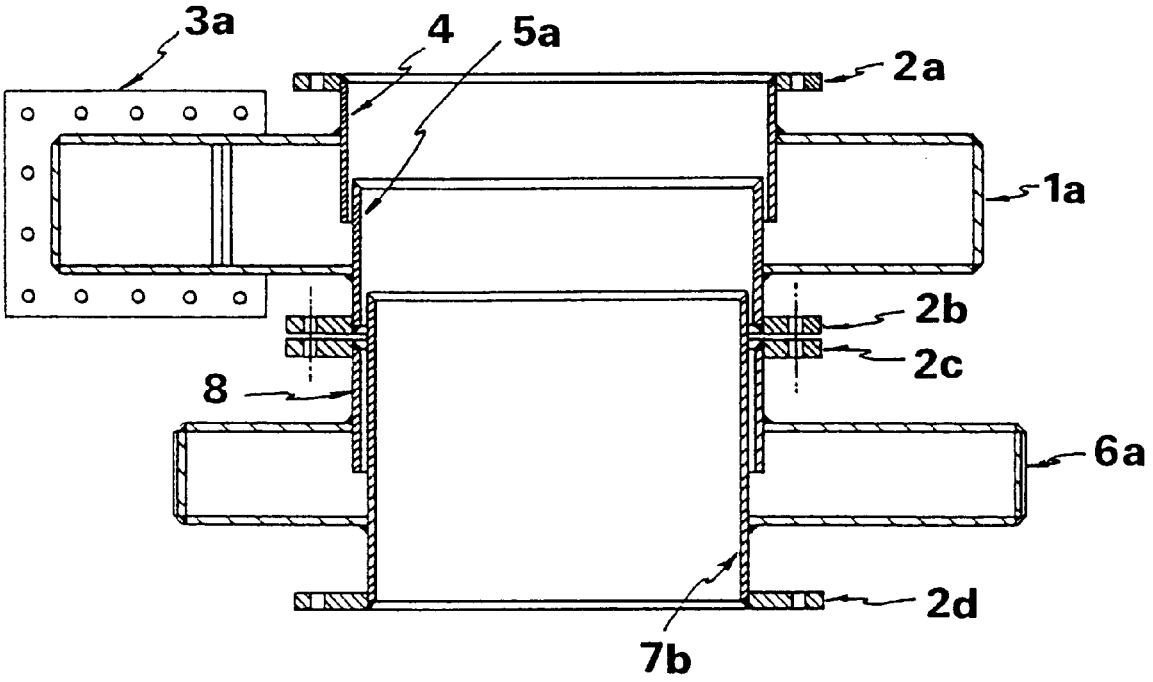
FIG. 8 is a longitudinal sectional view of a combination of the modular 2nd stage induction apparatus and the modular 1st stage induction apparatus mounted thereon, taken along "8—8" of FIG. 7.

FIG. 8 is a longitudinal sectional view of a combination of the modular 2nd stage induction apparatus and the modular 1st stage induction apparatus mounted thereon, taken along "8—8" of FIG. 7. Pressurized steam in the 2nd stage plenum 6*a* is injected upward through an annular steam-jet passage defined by inner surface of the 2nd stage OC 8 of which the inner diameter is the same as the 1st stage IC 5*a* and outer surface of the 2nd stage IC 7*b* of which the outer diameter is smaller in magnitude thereof than the 2nd stage OC 8. The 2nd stage plenum 6*a* has at least one pressurized steam intake flange 9*a* (shown in FIG. 7 ), a 3rd circular opening on upper side thereof, and a 4th circular opening on lower side thereof. Virtual center line of the 3rd circular hole and of the 4th circular opening is in coaxial alignment. Lower end of the 2nd stage OC 8 is inserted through the 3rd circular opening in downward direction along the virtual center line and welded; and upper end of the 2nd stage IC 7*b* is inserted through the 4th circular opening in upward direction along the virtual center line and welded such that steam escapes through a second annular passage defined by outer surface of the 2nd stage IC 7*b* and inner surface of the 2nd stage OC 8 so that exhaustion of flue gas flowing upward inside the 2nd stage IC 7*b* is boosted due to annular jet of air in the 1st stage plenum la through the first annular passage and to annular jet of steam in the 2nd stage plenum 6*a* through the second annular passage.

Figure 9:
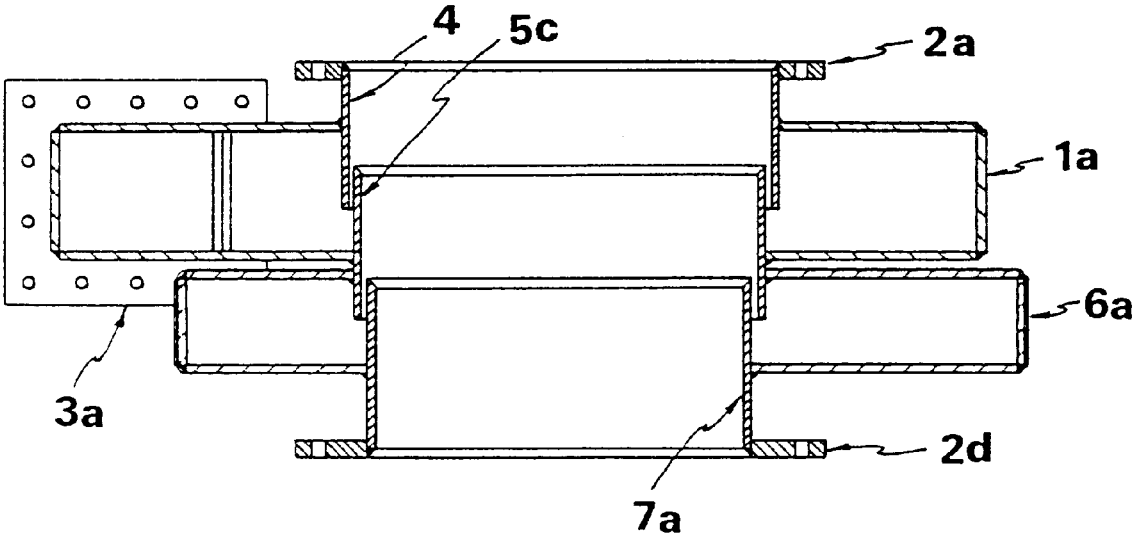
FIG. 9 is a longitudinal sectional view of a modular double-stage induction apparatus also in compliance with the present invention, also taken along "9—9" of FIG. 7.

FIG. 9 is a longitudinal sectional view of a modular double-stage induction apparatus in accordance with the present invention, also taken along "9—9" of FIG. 7. One of the differences between the combinational assembly of the 1st and 2nd modular apparati as shown in FIG. 8 and the modular double-stage induction apparatus as shown in FIG. 9 is that an intermediate cylinder( hereinafter referred to as "IMC" ) 5*c* replaces the 1st stage IC 5*a*, the 1st stage upstream mounting flange 2*b*, the 2nd stage downstream mounting flange 2*c*, and the 2nd stage OC 8. Upper end of the IMC 5*c* is inserted through the second circular opening on the lower side of the 1st stage plenum 1*a* and welded, and lower end through the first circular opening on the upper side of the 2nd stage plenum 6*a* and welded. The relative orientation of intake duct for steam in the 2nd stage plenum 6*a* with respect to intake duct for air in the 1st stage plenum 1*a* is fixed for this embodiment while that for the combinational assembly of the two induction apparati as shown in FIG. 8 is adjustable.

FIG. 10 is a perspective view of the modular double-stage pressure-drop induction apparatus having an air plenum 1*a* with one air intake port having an air intake flange 3*a* thereon, and a steam plenum 6*a* with one steam intake port having a steam intake flange 9*a* thereon. Absolute angular orientation of the air intake port is 270 deg. while that of the steam port is 0 deg. This perspective view corresponds to the double-stage induction apparatus as shown in FIG. 9. One of the advantages of this embodiment compared with two independent separate induction apparati as shown in FIG. 8 is cost reduction in manufacturing thereof.

FIG. 11 is a perspective view of the modular double-stage pressure-drop induction apparatus having an air plenum 1*a* with one air intake port having an air intake flange 3*a* thereon at 270 deg. position, and a steam plenum 6*b* with two steam intake ports, one at 0 deg. position and the other one at 180 deg. position, each having a steam intake flange 9*b* thereon. It is to be noted that the working fluid for each of the two intake ports may be different from each other. On the other hand, the square air intake flange 3*a* and steam intake flange 9*a* of FIG. 10 may be varied into a circular flange depending on the specific requirements of the apparatus to which these apparati are mounted or connected optionally with flow rate control devices therebetween.

Figure 12:
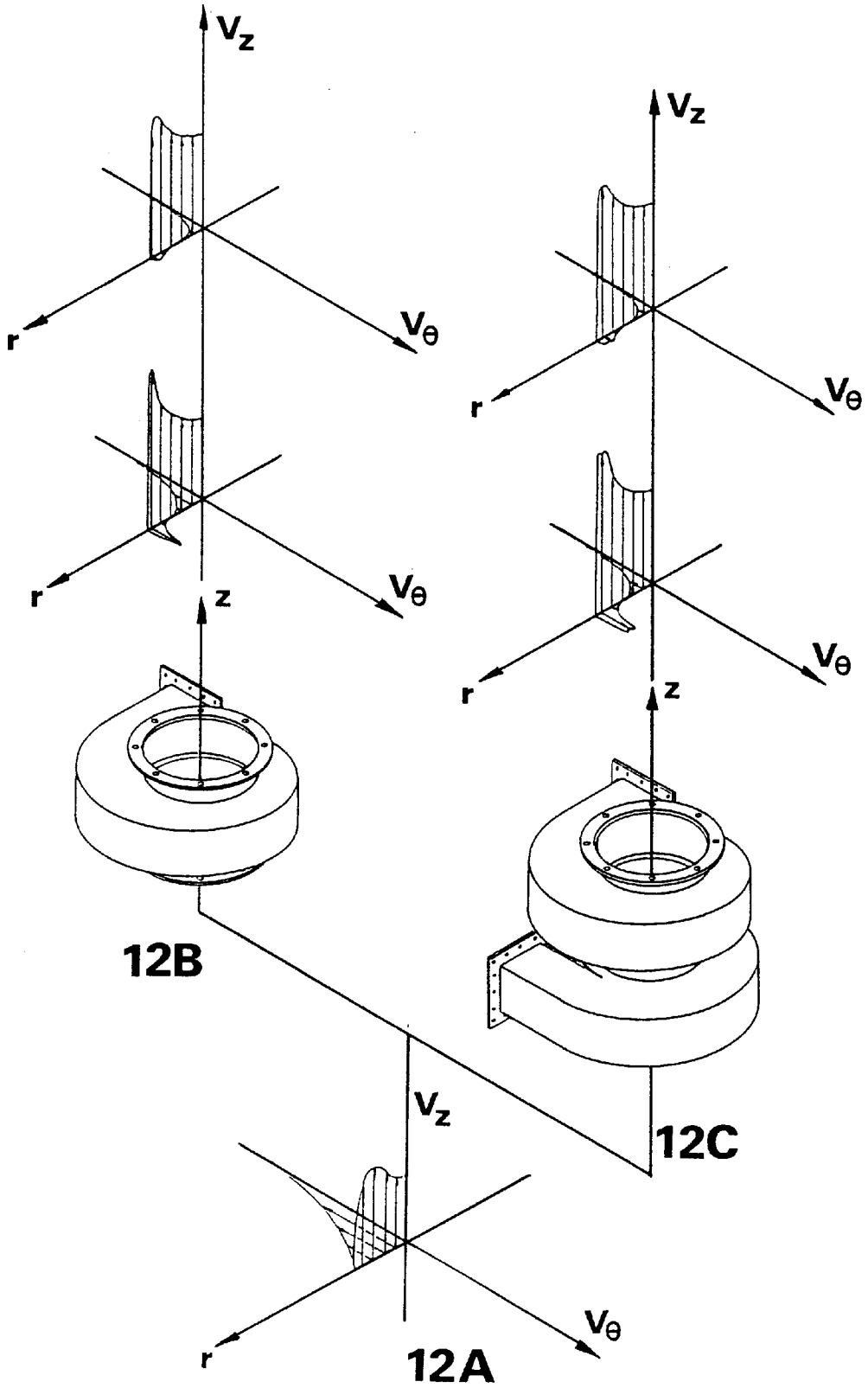
FIG. 12: 12A, 12B, and 12C shows velocity profile of flue gas upstream of the induction apparatus, downstream of the modular 1st stage induction apparatus only, and downstream of the modular double-stage induction apparatus respectively.

Finally, FIG. 12A, 12B, and 12C shows one typical example of velocity profile of flue gas upstream of the induction apparatus, downstream of the modular 1st stage induction apparatus only, and downstream of the modular double-stage induction apparatus respectively. FIG. 12A shows typical example of circumferential and axial velocity profile as of the flue gas from the central exhaust piping of a cyclone separator; FIG. 12B at two different elevations downstream of the single stage induction module as shown in FIG. 4A; and FIG. 12C at the two different elevations downstream of the double stage induction module as shown in FIG. 10. One important constraint in determining the magnitude of the annular passage through which air and/or steam or any other third gas state working fluid passes is that the space-average velocity of those gases need to be much higher than that of the flue gas for considerable magnitude of pressure drop between upstream and downstream of the pressure-drop inducing apparatus. In achieving this objective, there are two ways, one being lowering the magnitude of clearance of the angular passage, the other one being increasing the stagnation pressure of air or steam when the present invention is utilized on an incinerator furnace or on a boiler. One surplus effect of the present invention is that the circumferential velocity component of mixture of the flue gas and air/steam dies out as it flows downstream of the apparatus if it is mounted such that the sense of the swirl of air in the air plenum or steam in the steam plenum is opposite to that of the flue gas upstream of the induction apparatus so that the kinetic energy component of the mixture gas particle due to the circumferential velocity component is gradually converted into the kinetic energy contributed essentially only from the axial velocity component as is illustrated in two circumferential velocity profiles of FIG. 12B or FIG. 12C.

While the specific embodiment of the invention in the foregoing description is for modular pressure-drop induction apparatus wherein the plenum confinement means formed of steel shells having up to two intake ports, it is believed obvious to those skilled in the art that other plenum confinement means having at least one intake port for each stage of the apparatus may be carried out. Also the plenum confinement means may be cast as a single body as with steel, aluminum or other metallic materials having proper mechanical behavior for achieving said purpose. In carrying out the invention, the outer, intermediate, and inner cylinder may be secured to the corresponding plenum confinement means as with threads.

Having described various embodiments for the 1st stage suction module, the 2nd suction module, a combination of the 1st and 2nd suction modules, and the double stage suction module in accordance with the invention, it is also believed obvious that integral and semi-integral apparatus for inducing pressure drop and other modifications and variations will be suggested to those skilled in the art in the light of the above teachings. It is therefore to be understood that changes may be made in the particular embodiment of the invention described which are within the full intended scope of the invention as defined by the appended claims.

What is claimed is:

1. An apparatus for inducing pressure drop on flue gas exhaustion, the apparatus comprising:

(a) a 1st stage outer cylinder (hereinafter referred to as "OC");

(b) a 1st stage inner cylinder (hereinafter referred to as "IC"), outer diameter of the 1st stage IC being smaller in magnitude thereof than inner diameter of the 1st stage OC; and (c) 1st stage plenum-confinement means having at least one pressurized first-gas intake port, a 1st circular opening on upper side of the 1st stage plenum-confinement means, and a 2nd circular opening on lower side of the 1st stage plenum-confinement means, virtual center line of the 1st circular opening and of the 2nd circular opening being in coaxial alignment, the 1st stage OC being inserted, with lower end thereof ahead, through the 1st circular opening in downward direction along the virtual center line and secured, the 1st stage IC being inserted, with upper end thereof ahead, through the 2nd circular opening in upward direction along the virtual center line and secured such that pressurized first gas in the 1st stage plenum-confinement means is driven through a first annular passage defined by outer surface of the 1st stage IC and inner surface of the 1st stage OC;

whereby exhaustion of flue gas flowing upward inside of the 1st stage IC is boosted downstream due to annular jet of the pressurized first gas in the 1st stage plenum-confinement means through the first annular passage.

2. The apparatus of claim 1, further comprising a 1st stage downstream mounting flange secured to upper end of the 1st stage OC.

3. The apparatus of claim 1, further comprising:

(a) a 1st stage upstream mounting flange secured to lower end of the 1st stage IC; and (b) a 1st stage downstream mounting flange secured to upper end of the 1st stage OC.

4. The apparatus of claim 3, further comprising:

(a) a 2nd stage OC, inner diameter of which is approximately the same in magnitude thereof as the inner diameter of the 1st stage IC;

(b) a 2nd stage downstream mounting flange secured to upper end of the 2nd stage OC, the 2nd stage downstream mounting flange being compatible with the 1st stage upstream mounting flange for hermetic seal;

(c) a 2nd stage IC, outer diameter of which is smaller in magnitude thereof than the inner diameter of the 2nd stage OC; and (d) 2nd stage plenum-confinement means having at least one pressurized second-gas intake port, a 3rd circular opening on upper side of the 2nd stage plenum-confinement means, and a 4th circular opening on lower side of the 2nd stage plenum-confinement means, virtual center line of the 3rd circular opening and of the 4th circular opening being in coaxial alignment, the 2nd stage OC being inserted, with lower end thereof ahead, through the 3rd circular opening in downward direction along the virtual center line of the 3rd circular opening and secured, the 2nd stage IC being inserted, with upper end thereof ahead, through the 4th circular opening in upward direction along the virtual center line of the 4th circular opening and secured such that pressurized second gas in the 2nd stage plenum-confinement means is driven through a second annular passage defined by outer surface of the 2nd stage IC and inner surface of the 2nd stage OC;

whereby exhaustion of the flue gas flowing through the 2nd stage IC is boosted upward due to annular jet of the pressurized second gas in the 2nd stage plenum-confinement means through the second annular passage.

5. The apparatus of claim 4, further comprising a 2nd stage upstream mounting flange secured to lower end of the 2nd stage IC.

6. The apparatus of claim 1, further comprising a 1st stage upstream mounting flange secured to lower end of the 1st stage IC.

7. The apparatus of claim 6, further comprising:

(a) a 2nd stage OC, inner diameter of which is approximately the same in magnitude thereof as the inner diameter of the 1st stage IC;

(b) a 2nd stage downstream mounting flange secured to upper end of the 2nd stage OC, the 2nd stage downstream mounting flange being compatible with the 1st stage upstream mounting flange for hermetic seal;

(c) a 2nd stage IC, outer diameter of which is smaller in magnitude thereof than the inner diameter of the 2nd stage OC; and (d) 2nd stage plenum-confinement means having at least one pressurized second-gas intake port, a 3rd circular opening on upper side of the 2nd stage plenum-confinement means, and a 4th circular opening on lower side of the 2nd stage plenum-confinement means, virtual center line of the 3rd circular opening and of the 4th circular opening being in coaxial alignment, the 2nd stage OC being inserted, with lower end thereof ahead, through the 3rd circular opening in downward direction along the virtual center line of the 3rd circular opening and secured, the 2nd stage IC being inserted, with upper end thereof ahead, through the 4th circular opening in upward direction along the virtual center line of the 4th circular opening and secured such that pressurized second gas in the 2nd stage plenum-confinement means is driven through a second annular passage defined by outer surface of the 2nd stage IC and inner surface of the 2nd stage OC; whereby exhaustion of the flue gas flowing through the 2nd stage IC is boosted upward due to annular jet of the pressurized second gas in the 2nd stage plenum-confinement means through the second annular passage.

8. The apparatus of claim 7, further comprising a 2nd stage upstream mounting flange secured to lower end of the 2nd stage IC.

9. An apparatus for inducing pressure drop on flue gas exhaustion, the apparatus comprising:

(a) an outer cylinder (hereinafter referred to as "OC");

(b) an intermediate cylinder (hereinafter referred to as "IMC"), outer diameter of the IMC being smaller in magnitude thereof than inner diameter of the OC;

(c) 1st stage plenum-confinement means having at least one pressurized first-gas intake port, a 1st circular opening on upper side of the 1st stage plenum-confinement means, and a 2nd circular opening on lower side of the 1st stage plenum-confinement means, virtual center line of the 1st circular opening and of the 2nd circular opening being in coaxial alignment, the OC being inserted, with lower end thereof ahead, through the 1st circular opening in downward direction along the virtual center line and secured, the IMC being inserted, with upper end thereof ahead, through the 2nd circular opening in upward direction along the virtual center line and secured such that pressurized first gas in the 1st stage plenum-confinement means is driven through a first annular passage defined by outer surface of the IMC and inner surface of the OC;

(d) an inner cylinder (hereinafter referred to as "IC"), outer diameter of the IC being smaller in magnitude thereof than inner diameter of the IMC; and (e) 2nd stage plenum-confinement means having at least one pressurized second-gas intake port, a 3rd circular opening on upper side of the 2nd stage plenum-confinement means, and a 4th circular opening on lower side of the 2nd stage plenum-confinement means, virtual center line of the 3rd circular opening and of the 4th circular opening being in coaxial alignment, the IMC being inserted, with lower end thereof ahead, through the 3rd circular opening in downward direction along the virtual center line and secured, the IC IC being inserted, with upper end thereof ahead, through the 4th circular opening in upward direction along the virtual center line and secured such that pressurized second gas in the 2nd stage plenum-confinement means is driven through a second annular passage defined by outer surface of the IC and inner surface of the IMC;

whereby exhaustion of flue gas flowing upward through the IC is boosted downstream due to annular jet of the pressurized first gas in the 1st stage plenum-confinement means through the first annular passage and to annular jet of the pressurized second gas in the 2nd stage plenum-confinement means through the second annular passage.

10. The apparatus of claim 9, further comprising:

(a) an upstream mounting flange secured to lower end of the IC; and (b) a downstream mounting flange secured to upper end of the OC.

11. The apparatus of claim 9, further comprising an upstream mounting flange secured to lower end of the IC.

12. The apparatus of claim 9, further comprising a downstream mounting flange secured to upper end of the OC.

* * * * *